US008365909B2

(12) United States Patent
Lachman

(10) Patent No.: US 8,365,909 B2
(45) Date of Patent: Feb. 5, 2013

(54) SPECIALLY SHAPED CARTON FOR VANITY SINK

(75) Inventor: Edward Lachman, Anaheim, CA (US)

(73) Assignee: RSI Home Products Management, Inc., Anaheim, CA (US)

( * ) Notice: Subject to any disclaimer, the term of this patent is extended or adjusted under 35 U.S.C. 154(b) by 0 days.

(21) Appl. No.: 13/083,372

(22) Filed: Apr. 8, 2011

(65) Prior Publication Data

US 2011/0247951 A1 Oct. 13, 2011

Related U.S. Application Data

(60) Provisional application No. 61/322,227, filed on Apr. 8, 2010.

(51) Int. Cl.
*B65D 25/10* (2006.01)
*B65D 5/50* (2006.01)

(52) U.S. Cl. ..... 206/321; 206/523; 206/594; 229/112

(58) Field of Classification Search ..... 206/320, 206/321, 591, 592, 594, 586, 585, 523; 229/111, 229/112

See application file for complete search history.

(56) References Cited

U.S. PATENT DOCUMENTS

| | | | | | |
|---|---|---|---|---|---|
| 2,132,632 | A | | 10/1938 | Kondolf | |
| 2,355,206 | A | | 8/1944 | Davidson, Jr. | |
| 2,541,368 | A | * | 2/1951 | Kloner | 206/454 |
| 3,014,581 | A | * | 12/1961 | Storck | 206/321 |
| 3,531,170 | A | | 9/1970 | Boyer | |
| 3,664,494 | A | | 5/1972 | Mergens | |
| 4,039,077 | A | * | 8/1977 | Sorenson | 206/320 |
| 4,244,509 | A | | 1/1981 | Dlugopolski | |
| 5,040,721 | A | * | 8/1991 | Essack | 229/112 |
| 5,322,212 | A | | 6/1994 | Strasevicz et al. | |
| 5,429,232 | A | | 7/1995 | Orr et al. | |
| 5,522,502 | A | | 6/1996 | Orr et al. | |
| 5,579,991 | A | | 12/1996 | Strasevicz et al. | |
| 5,794,785 | A | | 8/1998 | Simon | |
| 7,431,159 | B2 | | 10/2008 | Lawrence et al. | |
| 2005/0263427 | A1 | * | 12/2005 | Schneider et al. | 206/523 |

* cited by examiner

*Primary Examiner* — Jacob K Ackun

(74) *Attorney, Agent, or Firm* — Knobbe, Martens, Olson & Bear, LLP

(57) ABSTRACT

A sink assembly is provided. The sink assembly can comprise a container having a generally trapezoidal shaped cross section. The container can be closed about a sink within the container. The sink can be supported in the container by at least one support element, for example a corner support, a top support having a generally triangular shape, and a drain support. Multiple sink assemblies can be efficiently stacked next to one another for shipping and/or storage.

7 Claims, 9 Drawing Sheets

SPECIALLY SHAPED CARTON FOR VANITY SINK

CLAIM OF PRIORITY

This application claims benefit under 35 U.S.C. §119(e) to U.S. Provisional Application No. 61/322,227, filed Apr. 8, 2010, which is incorporated in its entirety by reference herein.

BACKGROUND OF THE INVENTION

1. Field of the Invention

This application relates to containers, specifically containers for storage, shipping, and/or display of vanity sinks.

2. Description of the Related Art

Vanity sinks are commonly used in homes, particularly in bathrooms. Vanity sinks often comprise a rectangular frame or structure (e.g. countertop) with a round or oval-shaped recessed bowl within the center of the frame, and a drain assembly located underneath the recessed bowl. Vanity sinks are often packaged in containers for storage, shipping, and/or display. Such containers often have a generally rectangular box-like structure, and are open along at least one side so as to display a portion the sink contained within.

SUMMARY OF THE INVENTION

An aspect of at least one of the embodiments disclosed herein includes the realization that rectangular box-like containers for vanity sinks, open on at least one side for displaying a sink, are not always adequate for preventing damage to the sink during shipment or storage. The open nature of the container permits debris or other material to contact the sink inside, damaging the recessed bowl or other areas of the sink. Thus, it would be advantageous to have a closed or at least closable container designed for shipping and/or storing vanity sinks.

Another aspect of at least one of the embodiments disclosed herein includes the realization that rectangular box-like containers for holding vanity sinks can often be bulky and space-consuming. It would be advantageous to have a closed container that more efficiently utilizes space in a storage facility, and more efficiently utilizes space on a common wooden shipping pallet.

Thus, in accordance with an embodiment, a sink assembly can comprise a closed container having a trapezoidal cross sectional shape, a vanity sink stored within the container, and at least one support element holding the vanity sink in place and protecting the vanity sink during storage and/or shipping.

In accordance with another embodiment, a method for storing and/or shipping vanity sinks can comprise placing vanity sinks in closable containers having a trapezoidal cross sectional shapes, surrounding the vanity sinks with at least one support element, closing the containers, and stacking the sink-filled containers vertically on a storage and/or shipping device.

BRIEF DESCRIPTION OF THE DRAWINGS

These and other features and advantages of the present embodiments will become more apparent upon reading the following detailed description and with reference to the accompanying drawings of the embodiments, in which:

FIG. 9 is a top, front, and left side perspective view of the sink of FIG. 1, with the support elements added on;

DETAILED DESCRIPTION OF THE PREFERRED EMBODIMENT

An improved sink assembly 10 is disclosed herein. The embodiments disclosed herein are described in the context of a vanity sink assembly for storing, shipping, and/or displaying vanity sinks. However, the embodiments and inventions herein can also be applied to other types of sinks, or to articles other than sinks.

Figure 1:
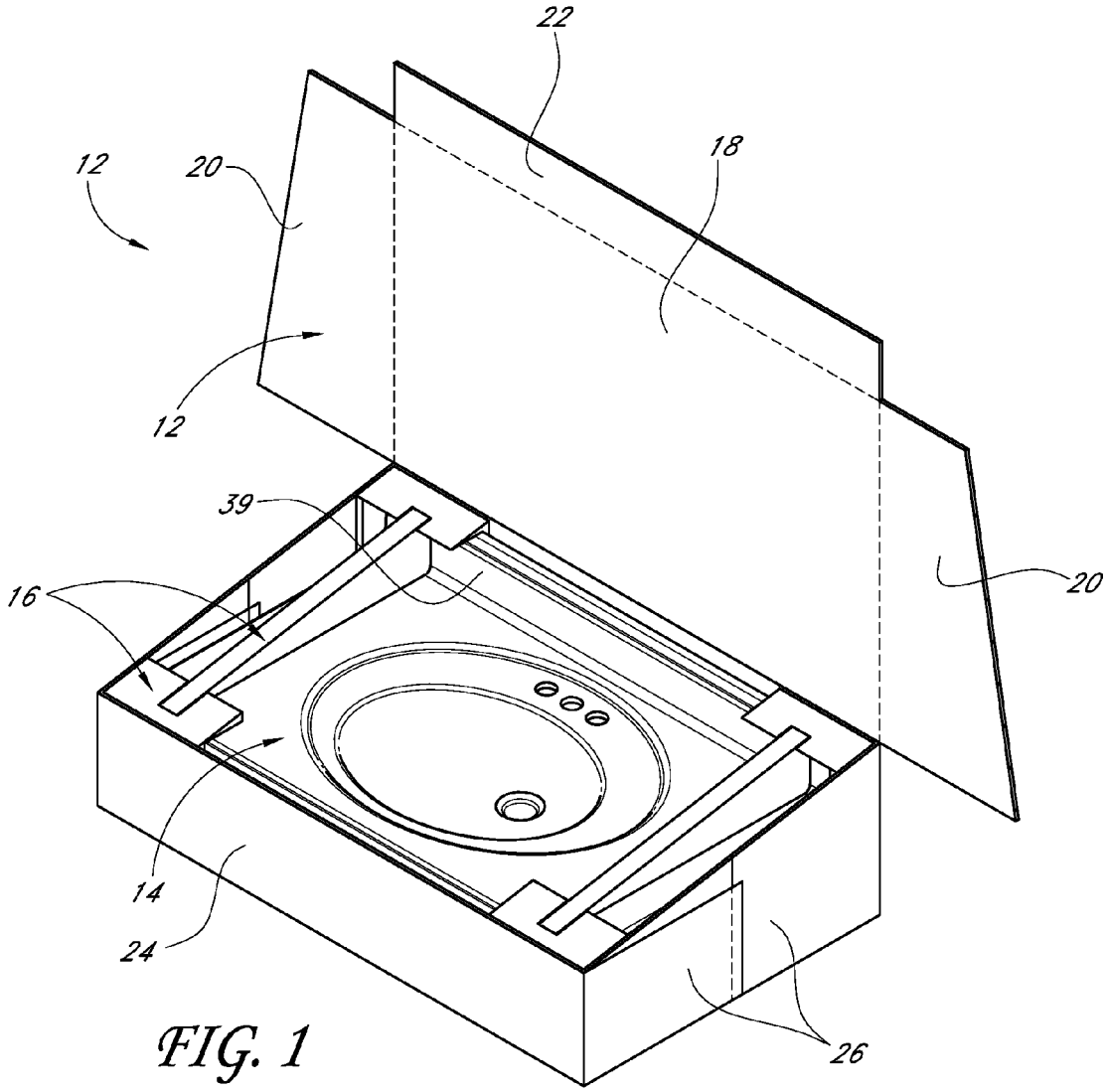
FIG. 1 is a top, front, and left side perspective view of a sink container assembly according to one embodiment, including a vanity sink stored inside a container and protected by support elements.

With reference to FIG. 1, the sink assembly 10 can comprise a container 12, a vanity sink 14, and at least one support element 16. The sink assembly 10 can be stored, shipped, and/or used for display.

Figure 2:
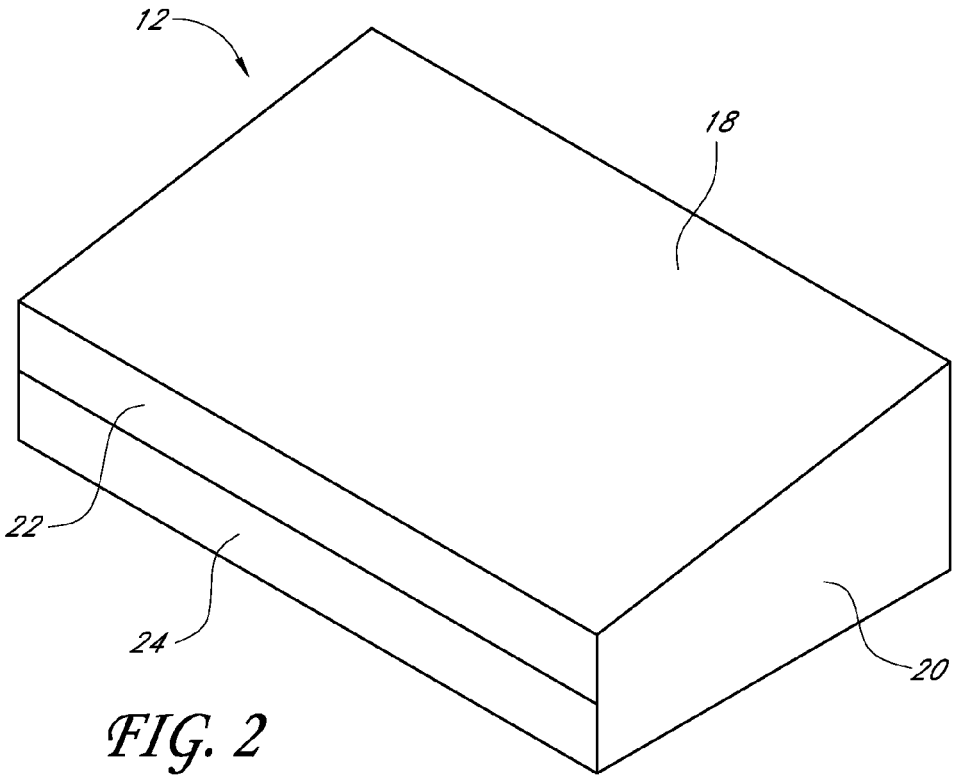
FIG. 2 is a top, front, and left side perspective view of the container of FIG. 1, shown closed.
Figure 3:
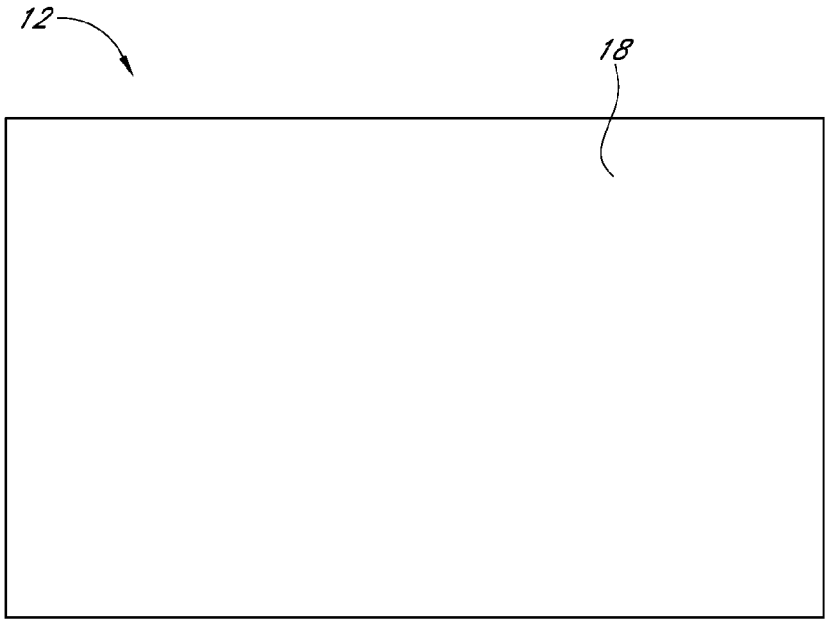
FIG. 3 is a top plan view of the container of FIG. 2, the bottom plan being a mirror image thereof.
Figure 4:
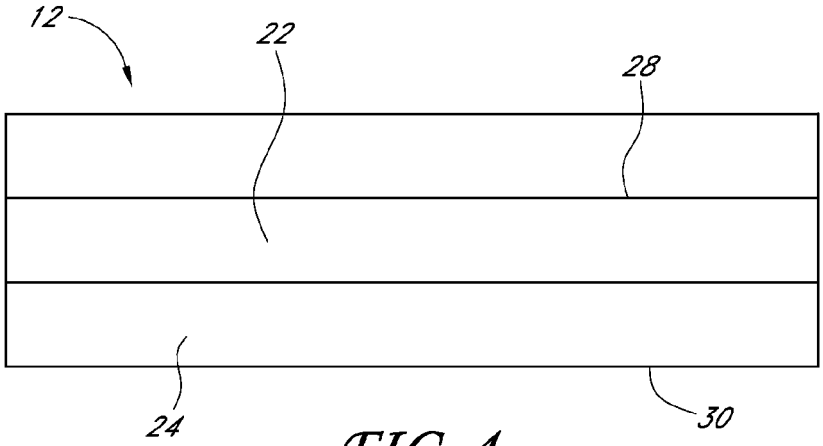
FIG. 4 is a front side elevational view of the container of FIG. 2.

With reference to FIGS. 1-6, the container 12 can be formed from cardboard or other suitable material for use in storing, shipping, and/or displaying the sink 12. The container 12 can be cut from one piece and folded, or can be made from separate pieces. In a preferred arrangement, the container 12 can be cut from a single piece, and can include a top portion 18. The top portion 18 can comprise flaps. For example, the top portion can comprise two side flaps 20, and a front flap 22. As illustrated in FIGS. 1 and 2, the top portion 18 of container 12 can be movable, and can be rotated relative to the rest of the container 12 so as to cover and protect the sink 14, or can be opened to display the sink 14. For example, the front flap 22 can be folded over a front face 24 of container 12, and the side flaps 20 can be folded over interior flaps 26 along sides of the container 12. In some embodiments the flaps 20 and 22 can be adhered to or attached to the interior flaps 26 and face 24, or other areas of the container 12, so as to seal the sink 14 within the container 12. In some embodiments, the container 12 can include flaps that can be releasably locked (e.g. with tabs, slots, etc.) in place. Other arrangements of flaps, folds, and/or locks are also possible.

With continued reference to FIGS. 1-6, the container 12 can be shaped so that it can easily and efficiently be stacked together with other containers 12. In some embodiments the container 12 has a generally trapezoidal shape and cross-section. For example, and with reference to FIG. 4, the height of a front side of the container 12, as measured between edges 28 and 30, can be approximately 8 inches. In some embodiments, the height can range between 7 inches and 9 inches. In some embodiments, the height can range between 6 inches and 10 inches. Other ranges are also possible.

Figure 5:
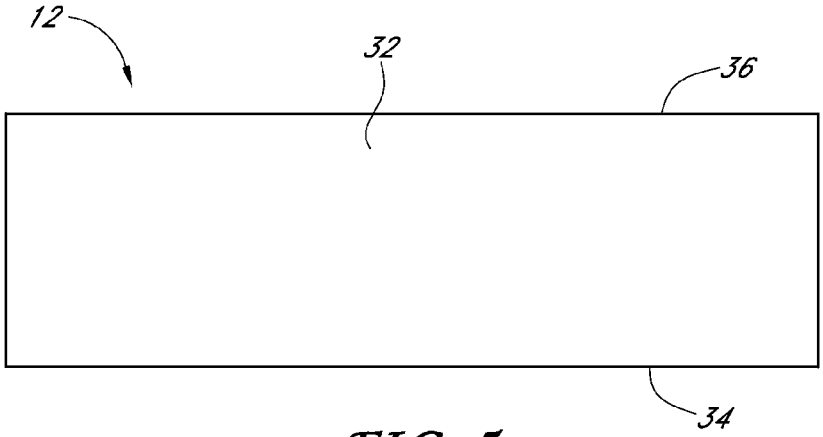
FIG. 5 is a back side elevational view of the container of FIG. 2.
Figure 6:
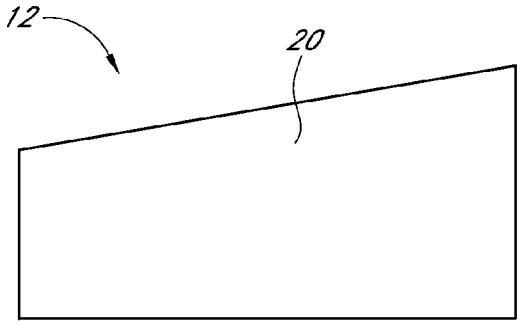
FIG. 6 is a left side elevational view of the container of FIG. 2, the right side being a mirror image thereof.

With reference to FIG. 5, the height of a back side 32 of container 12, as measured between a bottom edge 34 and a top edge 36, can be approximately 12 inches. In some embodiments, the height can range between 11 inches and 13 inches. In some embodiments, the height can range between 10 inches and 14 inches. Other ranges are also possible.

The trapezoidal shape of the container 12 can advantageously reduce the space that each container 12 takes up in a storage facility, or on a shipping device, as compared with a generally rectangular-shaped container. This allows more containers 12, and consequently more sinks 14 and assemblies 10, to be stored in any given space. For example, and with reference to FIG. 7, in some embodiments the trapezoidal shape of the container 12 can permit at least 8 sink assemblies 10 to be stacked vertically together on a common 40" wide pallet 38. This vertical stacking of trapezoidal containers 12 can inhibit at least some of the containers 12 from sliding off the wooden pallet 38 or pulling away from other containers 12, due to the trapezoidal shape that can keep the containers 12 generally locked together. Furthermore, often times the sink 14 can have a backsplash 39. If packaged in a traditional rectangular container, the backsplash 39 can create a large, empty unused space or void in the packaging. By utilizing a trapezoidal shape, this space or void can be partially or entirely eliminated.

Figure 7:
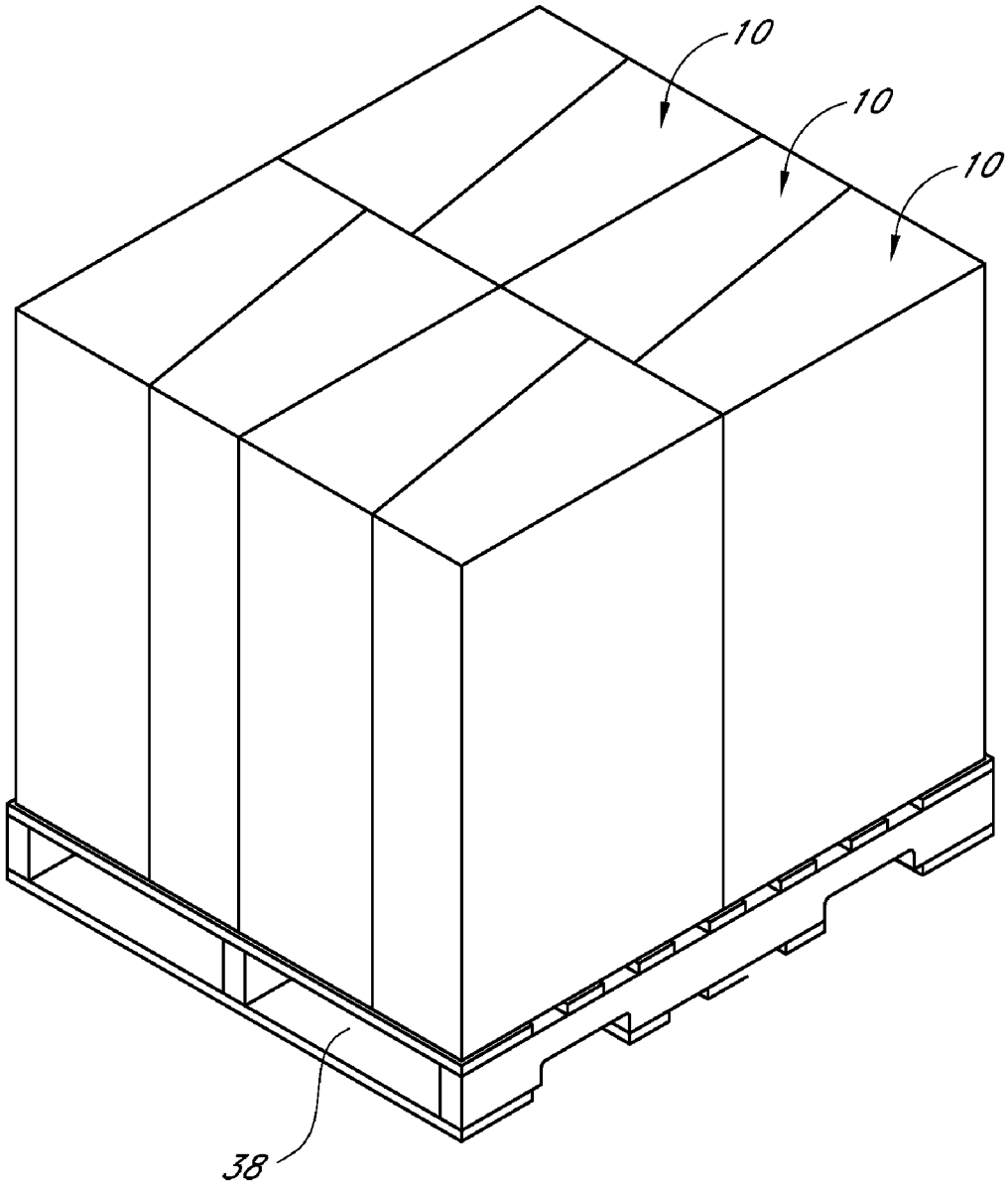
FIG. 7 is a perspective view of numerous sink assemblies stacked vertically on a wooden storage/shipping pallet.
Figure 8:
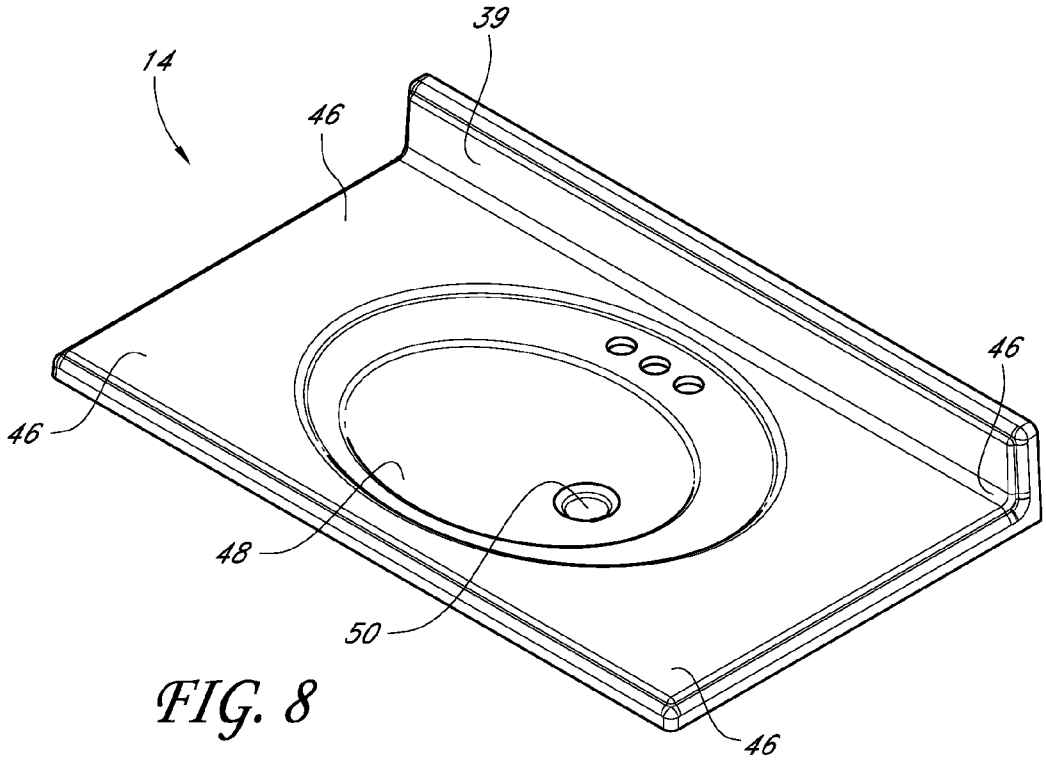
FIG. 8 is a top, front, and left side perspective view of the sink of FIG. 1.
Figure 9:
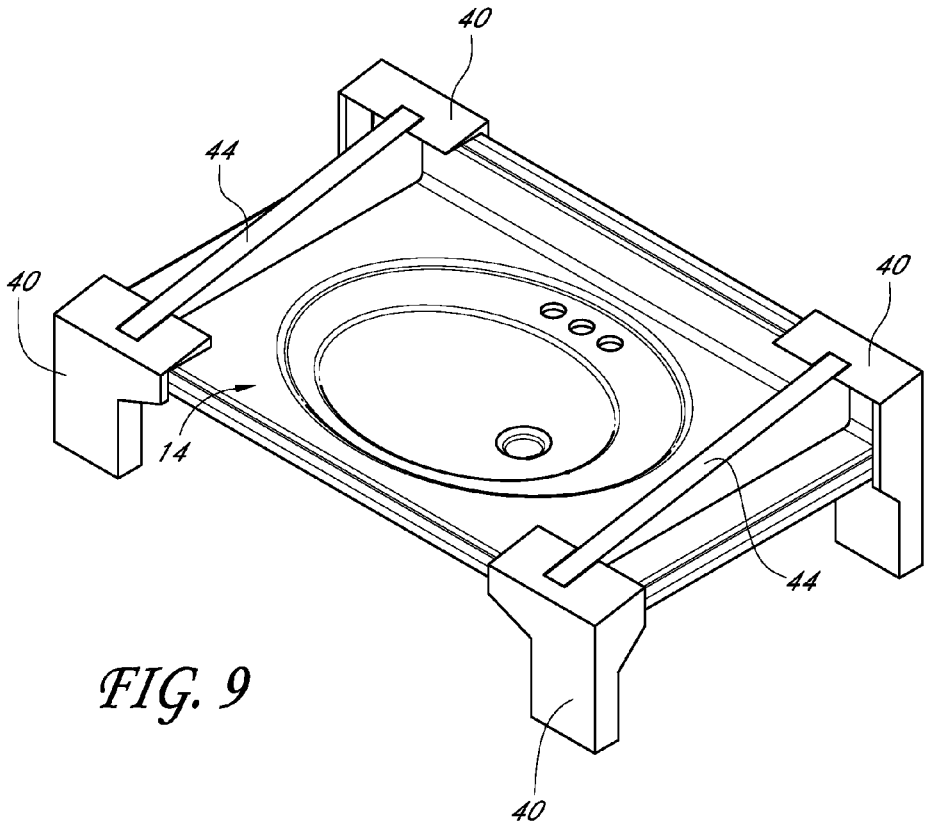

With reference to FIGS. 8-15, the sink assemblies 10 can include support elements 16 to protect the sink 14 from unwanted movement or damage during storage and/or shipping, including during times when the sinks are vertically stacked such as shown in FIG. 7. With reference to FIGS. 1 and 8-10, the support elements 16 can include at least one corner support 40, at least one drain support 42, and at least one top support 44. The corner supports 40 can extend from a bottom of the container 12 to the top portion 18 adjacent each corner of the container 12. The corner supports 40 can hold onto a corner of the sink 14. For example, and with reference to FIG. 8, the sink 14 can have four square corners 46 defining a frame, and a recessed bowl 48 within the frame, including a drain 50 extending beneath the bowl 48. The corner supports 40 can grasp and/or contact the corners 46 of sink 14, thereby holding the frame of the sink 14 relatively still. The corner supports 40 can be made of cardboard or other suitable material.

Figure 10:
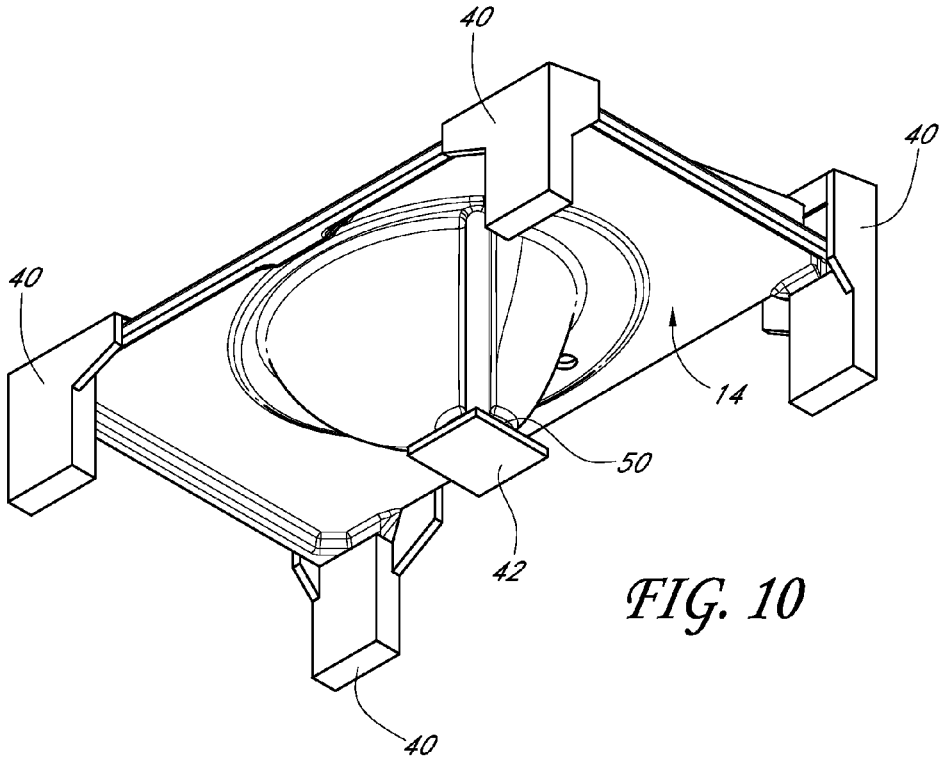
FIG. 10 is a bottom, front, and left side perspective view of the sink of FIG. 8, showing a support element underneath the sink drain.
Figure 11:
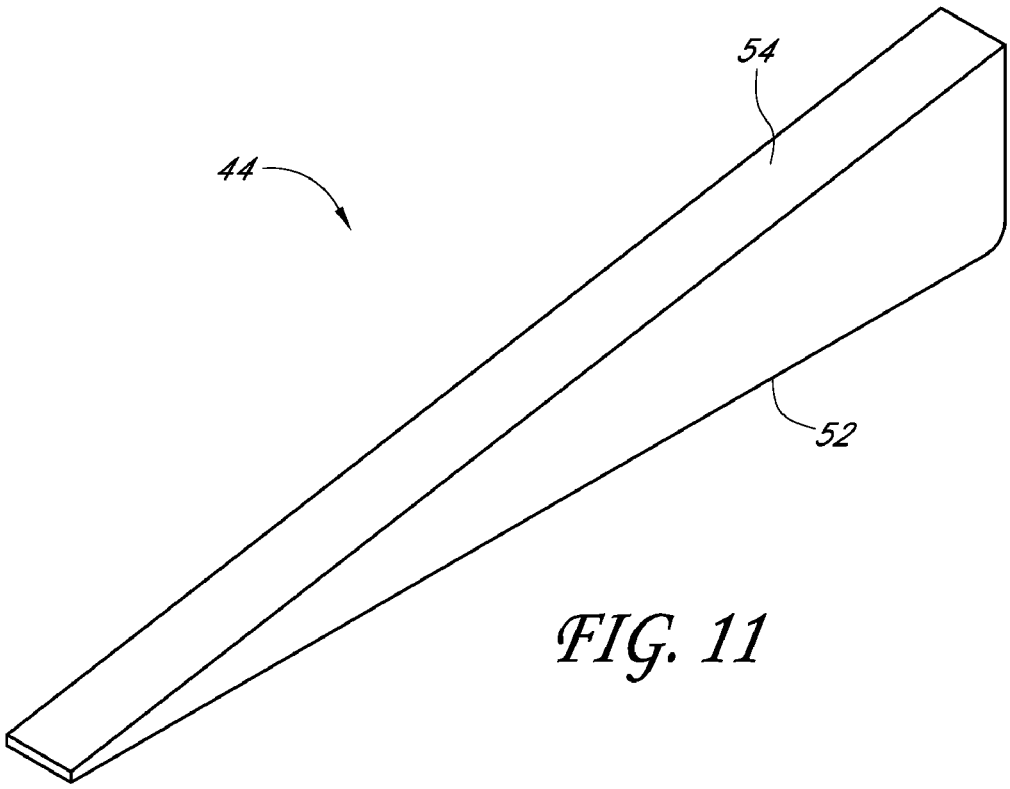
FIG. 11 is a top, front, and left side perspective view of one of the supports of FIG. 1.
Figure 12:
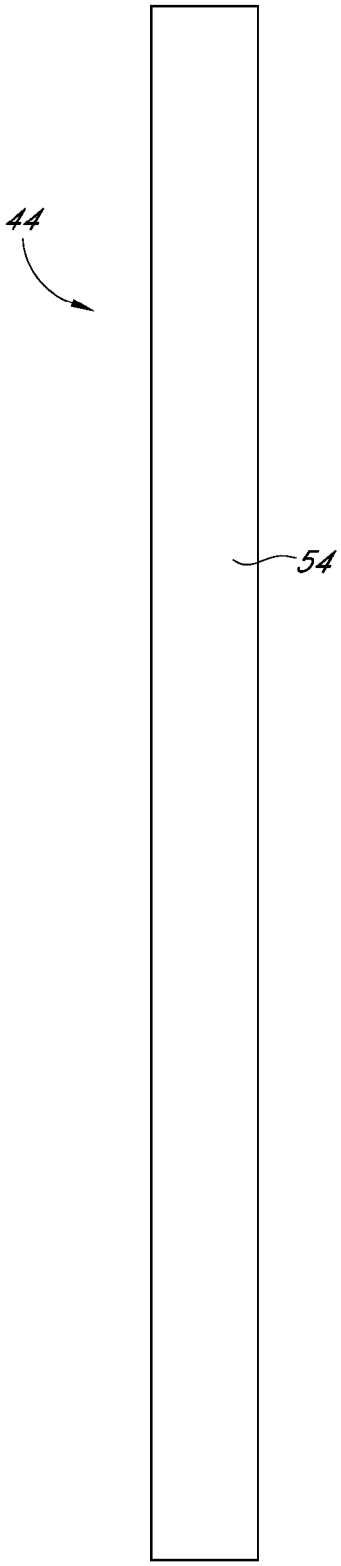
FIG. 12 is a top plan view of the support element of FIG. 10, the bottom plan being a mirror image thereof.
Figure 13:
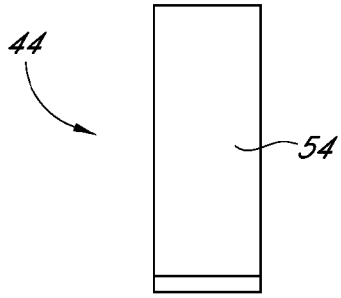
FIG. 13 is a front side elevational view of the support element of FIG. 10.
Figure 14:
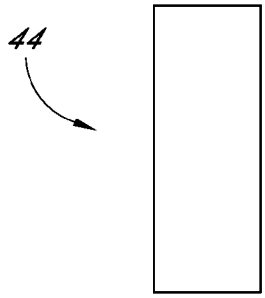
FIG. 14 is a back side elevational view of the support element of FIG. 10.
Figure 15:
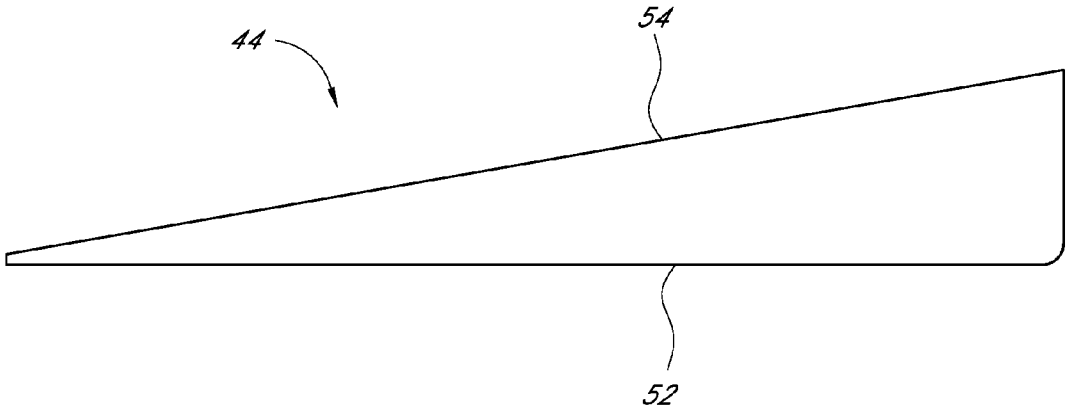
FIG. 15 is a left side elevational view of the support element of FIG. 10, the right side being a mirror image thereof.

With reference to FIG. 10, the drain support 42 can comprise a square or other suitably-shaped piece of material for protecting the drain 50. The drain support can be attached to the drain 50, or can be placed (e.g. wedged) between the drain 50 and the bottom of the container 12. The drain support 42 can be made of cardboard or other suitable material.

With reference to FIGS. 11-15, the top support 44 can be used to protect the sink 14 from unwanted shifting or movement within the container 12. The top support 44 can have a generally triangular shape, and in some embodiments can be comprised of foam or other suitable material. The top support or supports 44 can be placed between the corner supports 40 (e.g. wedged between). In some embodiments, a bottom edge 52 of top support 44 can rest on the sink 14, and a top edge 54 can contact or be substantially close to contacting the top portion 18 of the container 12. The triangular shape of top support 44 can provide protection for the sink 14, without having to increase the size of the container 12. If the container 12 were to shift, move, or fall, the top support or supports 44 can provide substantial protection for the sink 14 inside, inhibiting damage to the sink 14. In some embodiments, the top support 44 can easily be removed after shipment, in order to remove the sink 14 and/or corner supports 40.

Other supports besides corner supports 40, drain support 42, and top supports 44 are also possible, as are other locations, orientations, numbers, and combinations of supports. For example, in some embodiments the assembly 10 can include four corner supports 40 and a drain support 42. In some embodiments the assembly 10 can include four corner supports 40, a drain support 42, and three top supports 44 placed across the sink 14. In some embodiments, the assembly can comprise four corner supports 40, and two top supports 44.

As described above, the assemblies 10 provide advantages over other sink assemblies in that they can easily and efficiently be stacked together, without any significant damage or movement occurring to the sink 14 inside. Due to the shape of the container 12, the assemblies can be stacked vertically and interlocked. The specially designed support elements 16 can hold the sinks 14 in place, and can allow for easy viewing and/or removal of the sinks 14 once the containers 12 are opened.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A sink assembly comprising:

a closed container having a trapezoidal cross sectional shape;

a vanity sink stored within the container; and at least one support element holding the vanity sink in place and protecting the vanity sink during storage and/or shipping;

wherein the at least one support element comprises four corner support elements holding corners of the sink, at least one top support element having a generally triangular shape placed between two of the corner supports, and a drain support element placed between a drain of the sink and a bottom of the container.

2. The sink assembly of claim 1, wherein the top support element is comprised of foam.

3. The sink assembly of claim 1, wherein the container has at least one flap.

4. The sink assembly of claim 3, wherein the container has a two side flaps and a front flap.

5. The sink assembly of claim 1, wherein the at least one support element comprises two generally triangular shaped top support elements.

6. The sink assembly of claim 1, wherein the container has a front side with a height of between approximately 7-9 inches.

7. The sink assembly of claim 1, wherein the container has a back side with a height of between approximately 11-13 inches.

* * * * *